US006741720B1

(12) United States Patent
Myatt

(10) Patent No.: US 6,741,720 B1
(45) Date of Patent: May 25, 2004

(54) IN-WALL LOUDSPEAKER SYSTEM

(75) Inventor: Jeffrey D. Myatt, Manchester, NH (US)

(73) Assignee: Russound/FMP, Inc., Newmarket, NH (US)

( * ) Notice: Subject to any disclaimer, the term of this patent is extended or adjusted under 35 U.S.C. 154(b) by 0 days.

(21) Appl. No.: 09/551,907

(22) Filed: Apr. 19, 2000

(51) Int. Cl.[7] ..... H04R 1/02
(52) U.S. Cl. ..... 381/386; 181/150
(58) Field of Search ..... 381/386, 349, 381/345, 87, 332, 335, 391, 387, 333, 301, 304, 305; 181/148, 153, 150, 155, 186, 199

(56) References Cited

U.S. PATENT DOCUMENTS

| | | | | | |
|---|---|---|---|---|---|
| 4,439,643 | A | * | 3/1984 | Schweizer | 179/146 |
| 5,574,796 | A | * | 11/1996 | Keezer | 381/188 |
| 5,734,732 | A | * | 3/1998 | Lemmon | 381/188 |
| 5,828,765 | A | * | 10/1998 | Gable | 381/386 |
| 5,847,331 | A | * | 12/1998 | Vollmer et al. | 181/147 |
| 5,937,073 | A | * | 8/1999 | Van Gieson | 381/391 |
| 6,101,262 | A | * | 8/2000 | Haase et al. | 381/386 |
| 6,243,478 | B1 | * | 6/2001 | Tsao | 381/388 |
| 6,320,971 | B1 | * | 11/2001 | Tozawa | 381/386 |
| 6,343,135 | B1 | * | 1/2002 | Ellero et al. | 381/387 |
| 6,415,036 | B1 | * | 7/2002 | Ritter et al. | 381/388 |

* cited by examiner

*Primary Examiner*—Duc Nguyen
*Assistant Examiner*—Lun-See Lao
(74) *Attorney, Agent, or Firm*—Weingarten, Schurgin, Gagnebin & Lebovici LLP

(57) ABSTRACT

An in-wall speaker system is provided having a speaker enclosure which achieves high quality sound and which can be readily installed in a standard residential or other wall structure. The enclosure comprises a relatively thin elongated, resonant-free housing at the upper portion of which is provided an opening in which a loudspeaker is mounted. The lower portion of the enclosure is shaped such that the enclosure can be angularly inserted through an opening in a mounting wall and pushed downward until the upper end of the enclosure containing the speaker is disposed in the wall opening. Fasteners are employed to secure the enclosure to the wall. The fasteners are preferably quick connect fasteners for easy installation. A speaker grille is provided to cover the loudspeaker. The enclosure has sufficient volume and configuration to provide enhanced sound reproduction. Various loudspeakers can be employed in the enclosure to produce intended sound performance. The speaker enclosure is sized and configured to fit between the studs of a standard residential wall structure and to fit within the wall space between the front and rear drywalls. The speaker system can include a detachable module containing a crossover circuit or an amplifier, and can include an infrared sensor and associated control circuitry for control of source components from the remote location of the speaker.

18 Claims, 3 Drawing Sheets

IN-WALL LOUDSPEAKER SYSTEM

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

Loudspeakers mounted in a wall are often used in a multi-room sound system for homes, offices and other facilities. The speaker is usually contained within a square or rectangular case which is inserted through an opening provided in a mounting wall. The case is secured to the wall by fasteners and a front grille is provided which is generally flush with or slightly protruding from the wall surface. Conventional in-wall speaker enclosures do not provide optimum acoustical conditions and do not provide sufficiently good sound quality which is preferable for high quality, high fidelity sound systems, especially where music reproduction is a primary use.

BRIEF SUMMARY OF THE INVENTION

In accordance with the present invention, an in-wall speaker system is provided having a speaker enclosure which achieves high quality sound and which can be readily installed in a standard residential or other wall structure. The enclosure comprises a relatively thin elongated, resonant-free housing at the upper portion of which is provided an opening in which a loudspeaker is mounted. The lower portion of the enclosure is shaped such that the enclosure can be angularly inserted through an opening in a mounting wall and pushed downward until the upper end of the enclosure containing the speaker is disposed in the wall opening. Fasteners are employed to secure the enclosure to the wall. The fasteners are preferably quick connect fasteners for easy installation. A speaker grille is provided to cover the loudspeaker, and this grille is generally in the form of a thin grille cloth retained on a surrounding frame which snaps onto the enclosure and is substantially flush with the mounting wall surface.

The enclosure has sufficient volume and configuration to provide enhanced sound reproduction. Various loudspeakers can be employed in the enclosure to produce intended sound performance. The speaker enclosure is sized and configured to fit between the studs of a standard residential wall structure and to fit within the wall space between front and rear drywalls.

The speaker system can include a detachable module containing a crossover circuit or an amplifier, which preferably is a digital bi-amplifier. The crossover can provide an intended frequency response which may be adjusted by controls on the speaker mounting. The amplifier can be provided for powering of the associated in-wall speaker. The speaker system can also include an infrared sensor and associated control circuitry for control of source components from the remote location of the speaker.

BRIEF DESCRIPTION OF THE SEVERAL VIEWS OF THE DRAWING

The invention will be more fully described from the following detailed description in conjunction with the accompanying drawings in which.

DETAILED DESCRIPTION OF THE INVENTION

Figure 3:
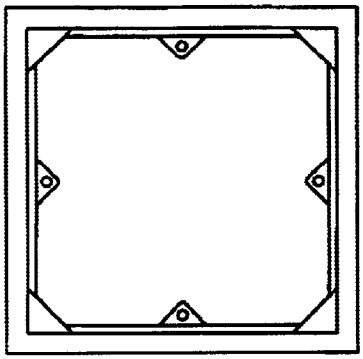
FIG. 3 is a front view of the speaker mounting frame of the embodiment of FIG. 1.
Figure 5:
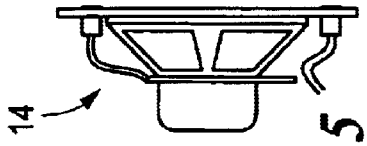
FIG. 5 is a side view of a speaker mountable in the speaker system of the invention.
Figure 4:
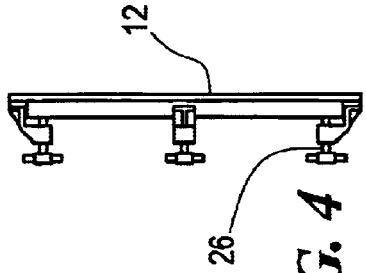
FIG. 4 is a side view of the speaker mounting frame of FIG. 3.

Referring to the drawings there is shown an in-wall speaker system which comprises enclosure 10, mounting frame 12, loudspeaker 14, and speaker grille 16. The enclosure is sized and configured to fit within a standard residential wall, and is mounted to the wall by fasteners. The speaker is usually covered by a grille cloth which is substantially flush with the mounting wall surface.

The enclosure 10 is of generally rectangular configuration when viewed from the front and having a square opening at the upper portion thereof in which mounting frame 12 and loudspeaker 14 is mounted. The speaker is sealed to the enclosure on which it is mounted to prevent air leakage.

A mounting flange 20 is provided around the speaker opening and is sized to abut the peripheral portion of the mounting opening in a wall. The enclosure walls 21 adjacent to the mounting flange are tapered rearwardly as illustrated. The enclosure includes a rear wall 22 which tapers toward the bottom 24 of the enclosure as illustrated. The taper of the enclosure allows the enclosure to be inserted through the mounting opening and down between the wall space between the front and rear walls to position the enclosure in the wall. The angled enclosure shape permits easy insertion and removal of the enclosure from a mounting wall without detracting from the volume and acoustical performance of the speaker enclosure. The tapered shape also provides a transmission line type of speaker enclosure which in conjunction with appropriate speakers provides good bass response.

The enclosure is preferably molded in unitary form of a suitable plastic material such as ABS. The enclosure may be formed of fire resistant material such as PVC. Acoustic damping material 25 can be provided on the enclosure on selected portions of the wall or on the entire wall surfaces to provide intended acoustic damping. The acoustic damping material may be glued to intended inner surfaces or may be painted, sprayed, or otherwise applied to the inner surfaces in liquid form and then dried.

The enclosure can be fabricated of a material having a honeycomb or other interior cell structure to provide intended damping without adding damping material. A combination of a cellular material and damping material or coating may also be used to provide intended acoustic characteristics.

The mounting frame 12 has the loudspeaker 14 mounted thereon and the frame and speaker are secured to the mounting flange 20 of the enclosure by fasteners 26. The mounting frame is substantially sealed to the confronting portions of the mounting flange such as by a gasket to provide a substantially sealed enclosure to prevent air leakage during speaker operation. The loudspeaker can be of any intended type to suit the particular sound reproducing requirements. The speaker may include low frequency, high frequency and mid range speakers arranged in a coaxial or triaxial configuration or can be implemented as multiple speakers mounted respectively on the mounting frame. The one or more loudspeakers are connected via wires 47 to a connector 40 for connection to a module 42 containing crossover and/or amplifier circuitry.

The mounting frame may also include quick connect connectors 49 connected to the wires 47 for easy connection and disconnection of the wiring to the speakers. An infrared sensor 52 can be provided on the mounting frame for communication with a remote control unit by which the speaker volume can be controlled if employed with a local amplifier, such as that contained within module 42. The sensor 52 can also be employed with a remote control for control of source components as is known in a multi-room sound system. High frequency and low frequency controls 54 can also be provided to adjust the intended frequency response of the crossover network.

A plurality of fasteners 30 are provided to secure the enclosure to the mounting wall. The fasteners are preferably of the quick connect type, such as cam lock fasteners. The speaker can be installed with a minimum of effort and a minimum of tools or installation skill. The cam locks quickly seat the back box against the mounting wall, eliminating the need for mounting screws or other discrete mounting hardware.

Figure 1:
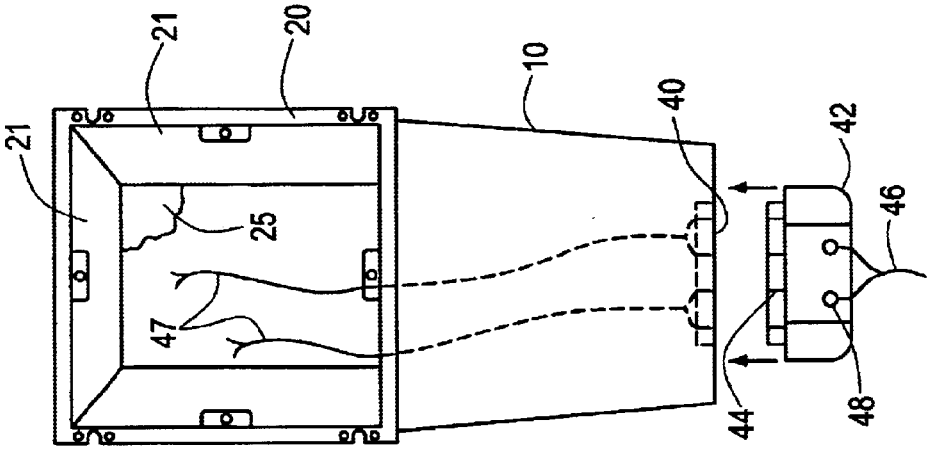
FIG. 1 is a front view of a speaker system in accordance with the invention.
Figure 2:
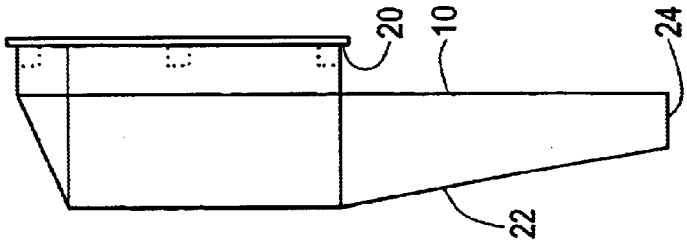
FIG. 2 is a side view of the speaker of FIG. 1.
Figure 6:
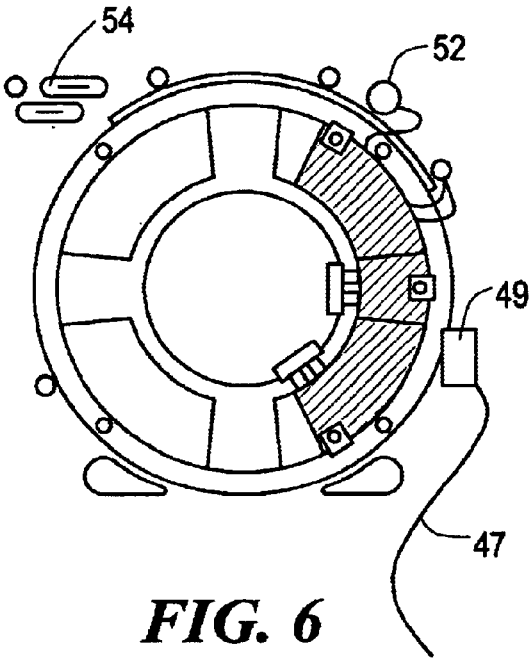
FIG. 6 is a front view of the speaker mounted in the mounting frame.
Figure 7:
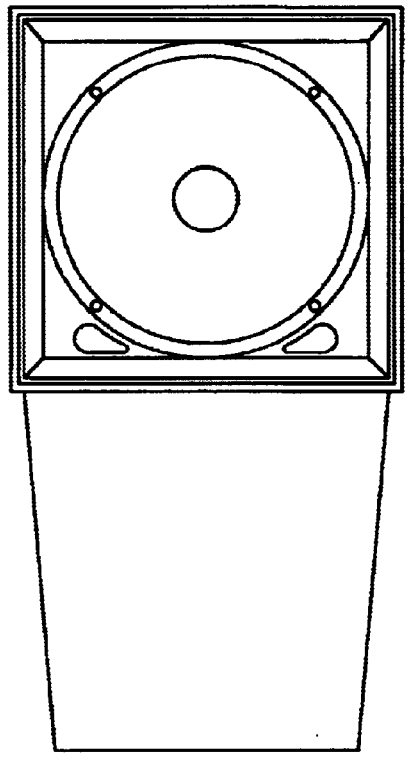
FIG. 7 is a front view of the mounting frame and speaker mounted to the enclosure.
Figure 8:
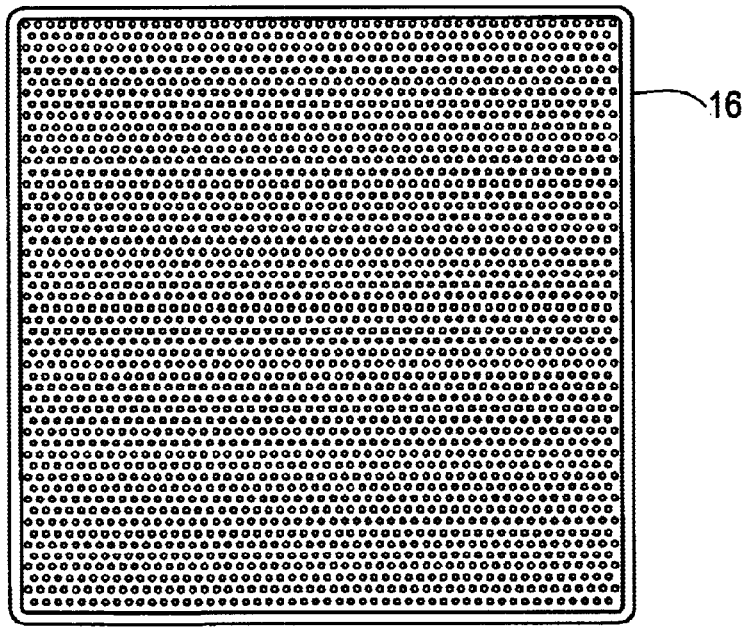
FIG. 8 is a front view of a speaker grille.

Referring to FIG. 1 there is shown a connector 40 in the bottom of the speaker enclosure. A module 42 has a mating connector 44 which is engageable with the connector 40. The module can include a crossover network or an amplifier. Wires 46 are connected to the terminals 48 of the module, these wires being connected to the source components. The detachable module provides for installation of different networks or amplifiers to suit particular sound reproduction purposes.

The module 42 may contain circuitry suitable for the particular installation requirements. As noted above, the circuitry can include a crossover network and such a network may be active or passive as is per se known in the art. The module may also contain one or more amplifier circuits for amplification of the signals applied to the one or more speakers mounted on the enclosure. The gain of the one or more amplifiers can be controlled via a wireless remote unit communicating by way of the infrared sensor 52. The speaker system can be an integral part of a multi-room audio system and can be coupled via a multi-wire cable to the source components. Power can be provided over the cable to the local amplifier or amplifiers for the loudspeaker. Control signals can also be provided over the cable.

It will be appreciated that the speaker system need not be employed with a local amplifier circuit. The speaker may be passive and powered by audio signals produced from the audio source and conveyed over the interconnecting cable directly to the speaker.

Different speakers can be provided to offer different sounds for different purposes. The speaker enclosure is acoustically designed to complement the sound reproduction and to minimize sound from escaping into adjoining rooms. In addition, the enclosure offers a back box that can be readily installed within the standard wall construction of homes or offices. The enclosure can be constructed of a fire resistant material.

Figure 9D:
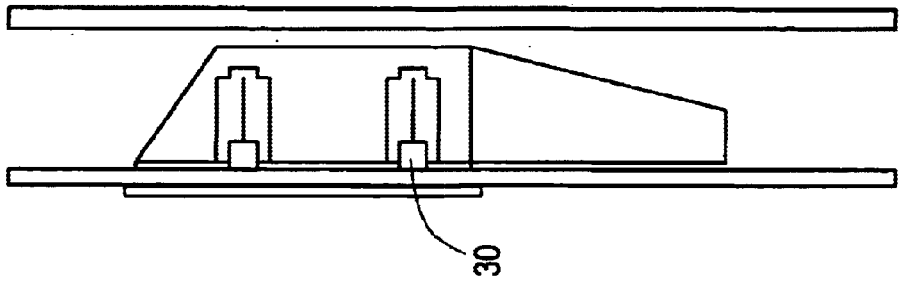
FIG. 9D is a side view of the speaker enclosure in its fully mounted position within a wall.
Figure 9C:
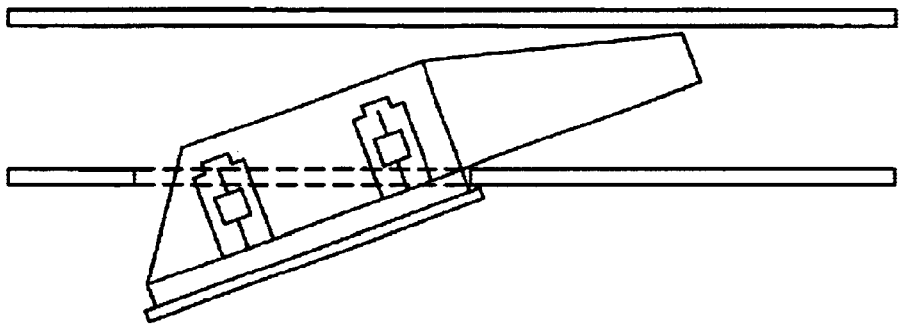
FIG. 9C illustrates the further installation of the speaker enclosure in its mounting position.
Figure 9B:
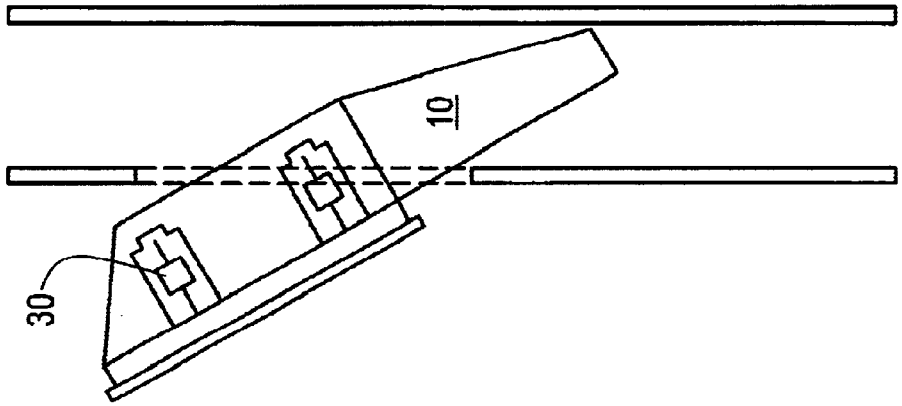
FIG. 9B illustrates the initial installation of the speaker enclosure in the mounting opening.
Figure 9A:
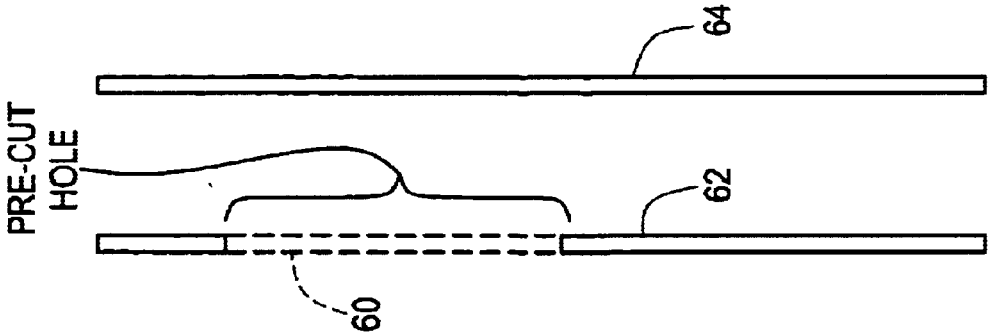
FIG. 9A is a side view of a mounting opening for the speaker.

The installation of a speaker system is illustrated in FIGS. 9A–9D. As shown in FIG. 9A a hole 60 is precut in a drywall 62 or other mounting wall of a room. The speaker is adapted to fit between the front wall 62 and rear wall 64 within the standard width of a residential wall structure. The precut hole is sized to accommodate the mounting portion of the speaker enclosure.

The enclosure 10 is inserted into the mounting hole 60 as shown in FIG. 9B. The shape of the enclosure permits it to be angularly inserted through the mounting hole and tilted downwardly with the lower portion of the enclosure fitted between the front and rear walls. The speaker enclosure is moved downwardly until the bottom of the mounting flange engages the bottom lip of the mounting hole, as shown in FIG. 9C. The enclosure is then tilted upwardly into a fully seated position as shown in FIG. 9D. The cam locks 30 are engaged against the rear surface of the front mounting wall to lock the speaker enclosure in its mounting position.

The invention is not to be limited by what has been particularly shown and described as variations and alternative implementations may occur to those versed in the art. The invention is intended to cover the spirit and true scope of the appended claims.

What is claimed is:

1. An in-wall speaker system comprising:

a speaker enclosure including a thin, resonant-free, elongated housing having an upper portion and a lower portion;

the upper portion having an opening for receiving a loudspeaker and a mounting flange about the loudspeaker opening;

a mounting frame attachable to the mounting flange and having at least one loudspeaker mounted thereon;

the lower portion of the enclosure having a tapered shape such that the enclosure can be angularly inserted through an opening in a mounting wall and pushed downward to seat the mounting flange of the upper end of the enclosure in a wall opening; and a plurality of fasteners operative to secure the enclosure to a mounting wall.

2. The speaker system of claim 1 further including a speaker grille attachable to the mounting flange of the enclosure.

3. The speaker system of claim 1 wherein each of the fasteners includes quick connect fasteners.

4. The speaker system of claim 1 wherein the enclosure includes an electrical connector;

and further including a module connectable to the electrical connector and containing circuitry for use with the loudspeaker.

5. The speaker system of claim 4 wherein the circuitry includes a crossover network.

6. The speaker system of claim 4 wherein the circuitry includes an amplifier.

7. The speaker system of claim 1 wherein the lower portion of the enclosure includes a back wall which downwardly tapers from the upper portion toward the bottom end of the enclosure.

8. The speaker system of claim 7 wherein the bottom end of the lower portion of the enclosure includes an electrical connector for connection to a detachable circuit module.

9. The speaker system of claim 1 wherein the enclosure is of unitary construction.

10. The speaker system of claim 9 wherein the enclosure has included on at least a portion of the inner walls thereof an acoustic damping material.

11. The speaker system of claim 1 further including an infrared sensor operative to communicate with a wireless infrared remote control device.

12. The speaker system of claim 1 wherein the mounting frame is attachable to the mounting flange of the enclosure by a plurality of fasteners.

13. The speaker system of claim 1 wherein the at least one loudspeaker is connected to the connector by a quick connect/disconnect electrical connector.

14. The speaker system of claim 1 further including an electrical connector mounted on the enclosure and connected to the at least one loudspeaker.

15. The speaker system of claim 1 in which the walls of the speaker enclosure adjacent to the mounting frame taper rearwardly away from the frame.

16. The speaker system of claim 1 wherein the speaker enclosure is formed of a cellular material having acoustic damping properties.

17. The speaker system of claim 16 wherein the speaker enclosure has acoustic damping material on at least a portion of the inner walls of the cellular material.

18. The speaker system of claim 4 wherein the enclosure has a bottom wall and a recessed portion, and wherein the electrical connector is mounted within the recessed portion.

* * * * *